United States Patent [19]

Parekh

[11] Patent Number: 4,606,705

[45] Date of Patent: Aug. 19, 1986

[54] VARIABLE DISPLACEMENT COMPRESSOR CONTROL VALVE ARRANGEMENT

[75] Inventor: Dinesh V. Parekh, E. Amherst, N.Y.

[73] Assignee: General Motors Corporation, Detroit, Mich.

[21] Appl. No.: 761,760

[22] Filed: Aug. 2, 1985

[51] Int. Cl.[4] ..... F04B 1/28

[52] U.S. Cl. ..... 417/222; 417/270

[58] Field of Search ..... 417/222, 270

[56] References Cited

U.S. PATENT DOCUMENTS

| | | | |
|---|---|---|---|
| 3,785,754 | 1/1974 | Miller | 417/213 |
| 4,351,152 | 9/1982 | Reynolds | 60/395 |
| 4,395,199 | 7/1983 | Izami | 417/53 |
| 4,487,109 | 12/1984 | Burandt | 91/506 |
| 4,494,911 | 1/1985 | Davis | 417/222 |
| 4,526,516 | 2/1985 | Swain | 417/222 |
| 4,533,299 | 8/1985 | Swain | 417/270 |

*Primary Examiner*—William L. Freeh

*Attorney, Agent, or Firm*—R. L. Phillips

[57] ABSTRACT

There is disclosed in a refrigerant compressor whose piston stroke and thereby displacement is controlled by crankcase-suction pressure differential, a control valve that is normally responsive to at least suction pressure to control such differential but is acted on by a solenoid above a prescribed compressor speed to increase the crankcase pressure to discharge pressure to effect minimum piston stroke and thereby minimum displacement to prolong compressor life.

2 Claims, 3 Drawing Figures

VARIABLE DISPLACEMENT COMPRESSOR CONTROL VALVE ARRANGEMENT

TECHNICAL FIELD

This invention relates to refrigerant compressors that are driven at varying speed and have a variable piston stroke and thereby displacement that is controlled by pressurizing the crankcase using fluid at discharge pressure and controlling the crankcase pressure relative to suction pressure. More particularly, this invention relates to a variable displacement control valve arrangement therefor that is normally responsive to at least compressor suction pressure to control the crankcase pressure so as to increase the compressor displacement with increasing suction pressure and in addition is operable to decrease the piston stroke and thereby the displacement to its minimum at a prescribed compressor speed.

BACKGROUND OF THE INVENTION

In variable displacement refrigerant compressors such as those of the variable angle wobble plate type used in motor vehicle air conditioning systems, and wherein a displacement control valve is utilized that is responsive to at least suction pressure to control the crankcase pressure to vary the wobble plate angle, it has been found desirable for extended compressor life expectancy to somehow in a practical way destroke or reduce the compressor displacement to its minimum above a predictable life limiting speed for the compressor.

SUMMARY OF THE INVENTION

The object of the present invention is to effect destroking of such a compressor above a prescribed speed in a very cost-efficient manner. To this end and in the preferred embodiment, there is left in place and utilized the displacement control valve that is normally responsive to at least suction pressure to control the crankcase pressure so as to increase the piston stroke with increasing suction pressure. It has been discovered that by simply adding a linear solenoid of sufficient output to such a normal displacement control valve and energizing same through a speed control switch at a preselected high compressor (engine) speed, the solenoid can be caused to operate on the valve so as to positively condition same regardless of the gas pressure forces then acting thereon so as to effect raising of the pressure in the crankcase to full discharge pressure. This rise in crankcase pressure immediately effects the desired destroking thus minimizing the compressor load at high compressor (engine) speeds while drive to the compressor from the motor vehicle remains and without requiring for example the addition of a separate valve and the accompanying necessary passages that would be required in adapting same to the compressor.

These and other objects, advantages and features of the present invention will become more apparent from the following description and drawing in which:

DETAILED DESCRIPTION OF THE PREFERRED EMBODIMENT

Figure 1:
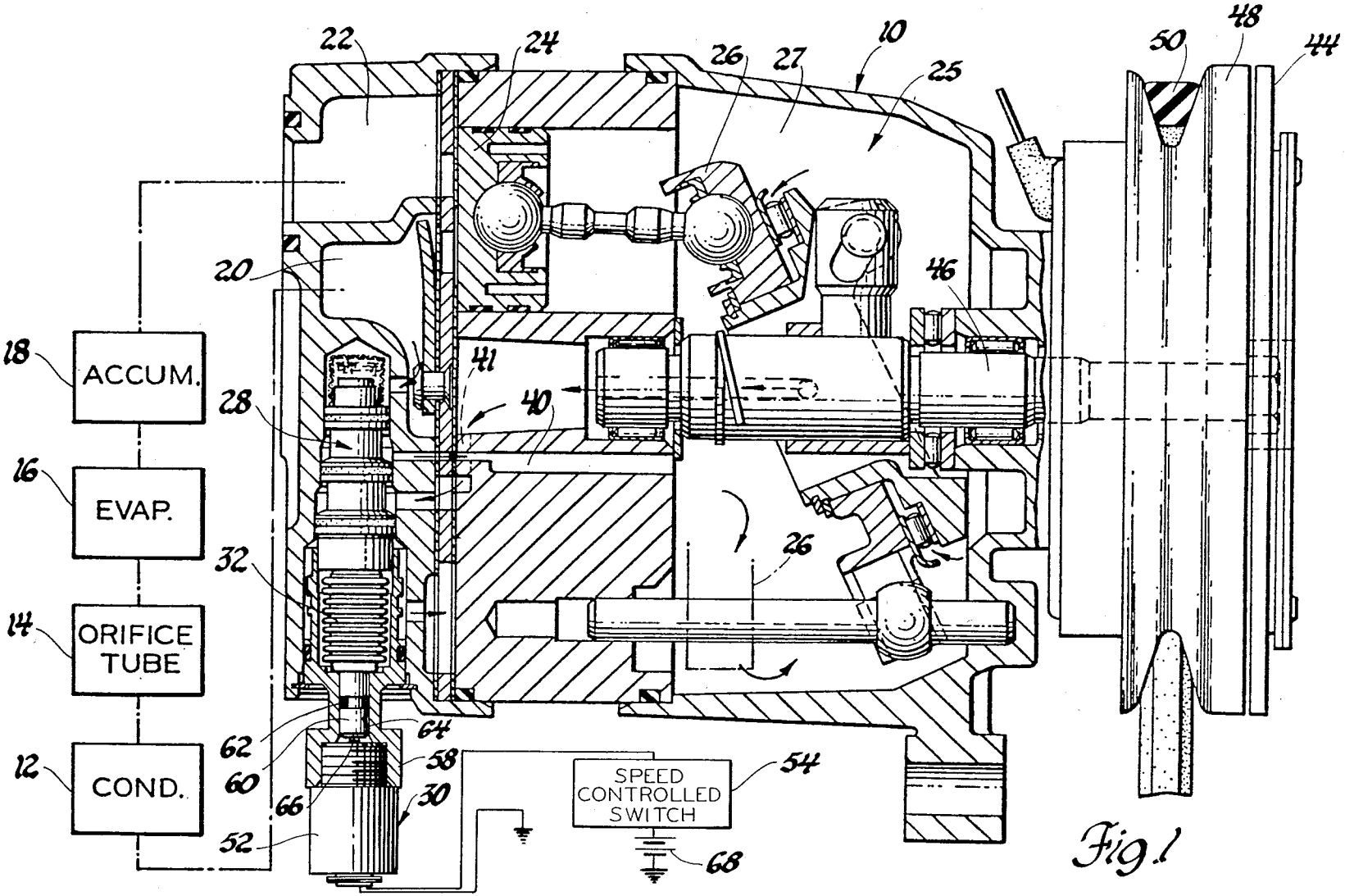
FIG. 1 is a cross-sectional view of a variable displacement refrigerant compressor of the variable angle wobble plate type having incorporated therein the preferred embodiment of the control valve arrangement according to the present invention. This figure further includes a schematic of a motor vehicle air conditioning system in which the compressor is connected.

Referring to FIG. 1, there is shown a variable displacement refrigerant compressor 10 of the variable angle wobble plate type connected in a motor vehicle air conditioning system having the normal condenser 12, orifice tube 14, evaporator 16 and accumulator 18 arranged in that order between the compressor's discharge and suction cavities 20 and 22 respectively.

The stroke of the five pistons 24 (only one being shown) and thereby the displacement of the compressor 10 is determined by the operating angle of the compressor's variable angle wobble plate mechanism 25 whose wobble plate 26 is made to angulate by pressurizing the sealed crankcase 27 using the refrigerant fluid at discharge pressure and controlling the pressure in the crankcase relative to suction pressure with a displacement control valve arrangement 28 that is responsive to at least compressor suction pressure so as to increase the stroke and thereby the displacement with increasing suction pressure. In the particular arrangement shown, the control valve arrangement is also responsive to discharge pressure so as to vary the wobble plate angle to increase the pistons' stroke and thereby displacement and discharge flow rate with both increasing suction and discharge pressures.

The details of the compressor 10 including the displacement control valve arrangement 28 but apart from the addition thereto according to the present invention of speed responsive destroke control means 30 is like that disclosed in U.S. Pat. Nos. 4,428,718 and 4,480,964 and assigned to the assignee of the present invention and which are hereby incorporated by reference.

Figure 2:
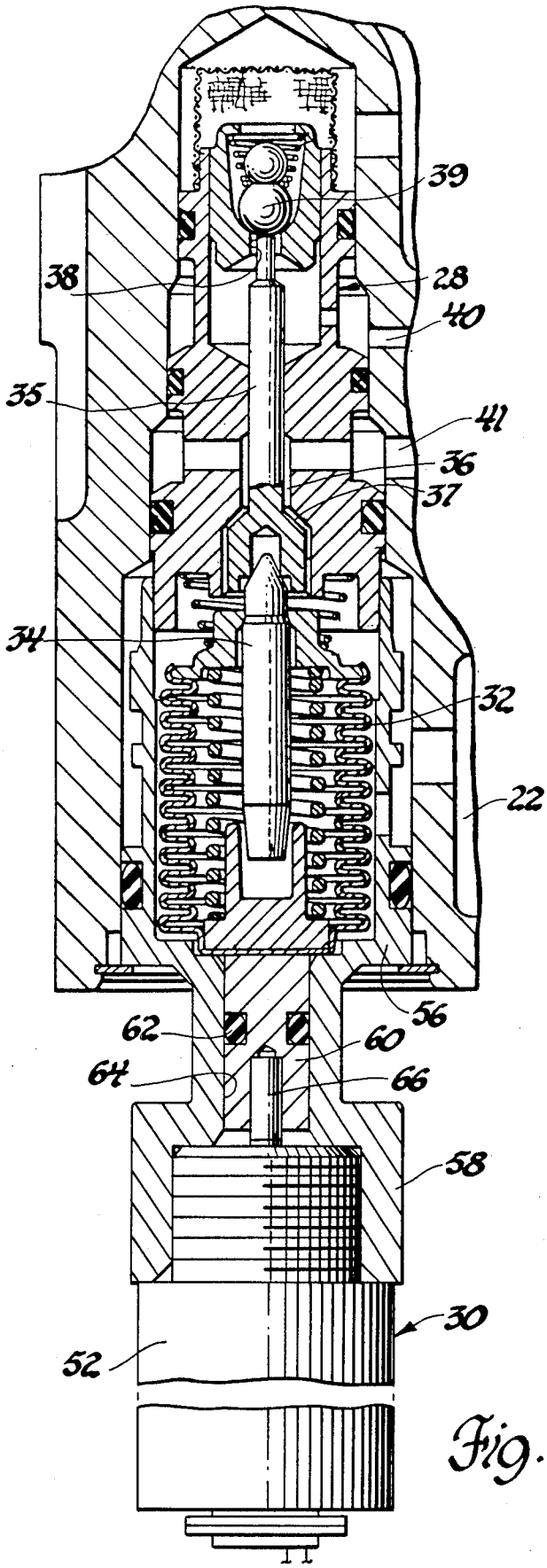
FIG. 2 is an enlarged cross-sectional view of the control valve arrangement in FIG. 1 and showing the control valve in a stroke demanding position.
Figure 3:
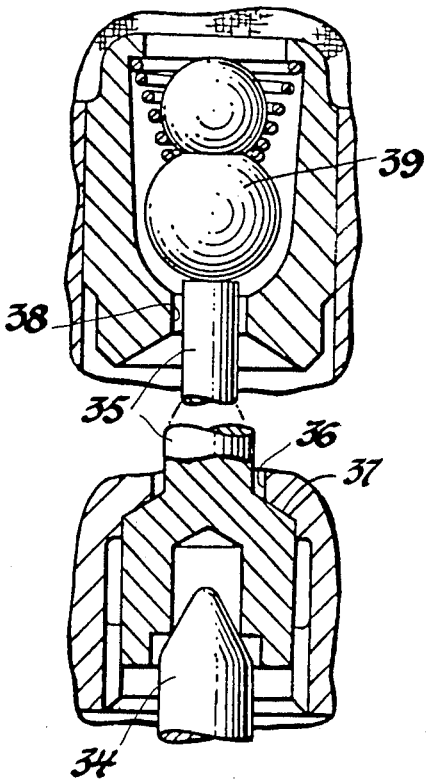
FIG. 3 is an enlarged view of a part of the control valve arrangement in FIG. 2 but showing the valve in a destroke position effected by the solenoid.

In such prior arrangement and during normal operation, gaseous refrigerant leaving the accumulator 18 at low pressure enters the compressor's suction cavity 22 and is discharged to the compressor's discharge cavity 20 and thence to the condenser 12 at a certain rate dependent on the compressor's wobble plate angle. At the same time, the gaseous refrigerant at suction pressure is transmitted at the compressor to act on an evacuated bellows 32 which tends to expand in response to a decrease in the suction pressure thus acting thereon to provide a force on a bellows output rod 34 which urges upward movement of an actuating valve pin member 35 as viewed in FIG. 2 and toward the position shown in FIG. 3 closing a crankcase bleed valve port 36 with its valve face 37 and simultaneously opening a crahkcase charge valve port 38 by lifting a ball valve 39. The crankcase charge valve port 38 when open communicates refrigerant in the discharge cavity with the crankcase via a passageway 40 and the crankcase bleed valve port 36 when open communicates the refrigerant in the crankcase with the suction cavity via a passageway 41 (these flow directions being shown by the arrows in FIGS. 1 and 2). The gaseous refrigerant discharge pressure at the compressor is also transmitted to act on the ball valve 39 in opposition to the bellows expansion to urge closing of the crankcase charge valve port 38 and simultaneous opening of the crankcase bleed valve port 36 as shown in FIG. 2. These variable pressure biases are in addition to the spring biases which act to normally condition the control valve arrangement 28 so as to close the crankcase charge valve port 38 and simultaneously open the crankcase bleed valve port 36 to thereby normally effect maximum compressor displacement by establishing zero crankcase-suction differential.

The objective of the displacement control is to match the compressor displacement with the air conditioning demand under all conditions so that the evaporator 16 is kept just above the freezing temperature (pressure) without cycling the compressor on and off with a clutch 44 which when energized operates to couple the compressor's drive shaft 46 to a pulley 48 that is driven by a belt 50 from the vehicle's engine (not shown). The optimum is to maintain as cold an evaporator as can be achieved at higher ambients without evaporator freeze and at lower ambients as high an evaporator temperature as can be maintained while still supplying some dehumidification. To this end, the control point of the control valve arrangement 28 determining displacement change is selected so that when the air conditioning demand is high, the suction pressure at the compressor after the pressure drop from the evaporator 16 will be above the control point (e.g. 170–210 kPa). The control valve arrangement is calibrated at assembly at the bellows 32 and with the spring biases so that the then existing discharge-suction pressure differential acting on the control valve arrangement is sufficiently high to maintain same in the condition shown in FIG. 2 closing the crankcase charge valve port 38 and opening the crankcase bleed valve port 36. The control valve arrangement will then maintain a bleed from the crankcase to suction via the passageway 41 while simultaneously closing off discharge pressure thereto so that no crankcase-suction pressure differential is developed. As a result, the wobble plate will remain in its maximum angle position shown in solid line in FIG. 1. Then when the air conditioning capacity demand reduces and the suction pressure reaches the control point, the resulting change in the discharge-suction pressure differential acting on the control valve arrangement conditions this valving to then open the crankcase charge valve port 38 and simultaneously close the crankcase bleed valve port 36 to thereby elevate the crankcase-suction pressure differential using discharge refrigerant delivered through the passageway 40. The angle of the wobble plate is controlled by a force balance on the pistons 24 so only a slight elevation (e.g. 40–100 kPa) of the crankcase-suction pressure differential is effective to create a net force on the pistons that results in a moment about the wobble plate pivot axis that reduces the wobble plate angle and thereby the compressor displacement (the minimum angle that produces minimum piston stroke being shown in phantom line in FIG. 1.

The control valve bellows 32 in addition to being acted on by the suction pressure has to also overcome discharge pressure in expanding to elevate the crankcase-suction pressure differential to reduce compressor displacement. As a result, the displacement change control point is thus depressed with increasing discharge pressure (higher ambients). In that the refrigerant flow rate and in turn suction line pressure drop increases with increasing discharge pressure (higher ambients), the control point is thus depressed proportional to the discharge pressure and likewise suction line pressure drop. This compressor displacement compensating feature permits controlling at the compressor suction while maintaining a nearly constant evaporator pressure (temperature above freezing) which has been found to result in substantially higher high load performance and reduced power consumption as disclosed in greater detail in the afore-mentioned U.S. Pat. Nos. 4,428,718 and 4,480,964. While this arrangement has been found to work satisfactorily, it has been discovered that extended running of the compressor at maximum piston stroke (displacement) above a certain high speed can substantially reduce the life of the compressor. This potential problem is avoided according to the present invention, in a very cost-efficient manner by the addition of the speed responsive control means 30 which operates to override the normal operation of the control valve arrangement 28 and positively condition it to destroke the compressor at and above the life limiting speed. This is preferably accomplished with with a simple linear solenoid 52 that is energized through a speed controlled switch 54 and operates directly on the control valve arrangement 30 to effect the desired destroking. For such adaptation, the bellows cover 56 is formed with a collar 58 that is internally threaded to receive the male thread of the solenoid 52. A cylindrical plunger 60 is slidably mounted and sealed with an O-ring 62 in a central bore 64 through the collar and engages at one end with the bellows 32 and at the other end is engaged by the linearly movable armature 66 of the solenoid. The solenoid is connected in the circuit shown in FIG. 1 so as to be energized by the vehicle battery 68 by operation of the speed controlled switch 54 that is set to close when the compressor speed exceeds a prescribed high speed such as 5000 rpm (4000 engine rpm). On such energization at the prescribed speed and assuming there is a then existing stroke demand condition, the solenoid 52 operates to move its armature 66 upward as shown in FIGS. 1 and 2 thereby positively forcing the actuating valve pin member 35 of the control valve arrangement 28 from its stroke demanding condition shown in FIG. 2 to its destroke demanding condition shown in FIG. 3 so as to effect dumping of the compressor discharge pressure to the crankcase while closing the latter to suction so that the compressor is immediately destroked. Thereafter, so long as the compressor speed remains above this prescribed limit, the control valve arrangement is held in its destroke condition by the energized solenoid. On the other hand, should the compressor already be at minimum stroke upon reaching the prescribed speed limit, the solenoid will operate to maintain such condition (prevent stroke increase) so long as this speed remains exceeded. But when the compressor speed falls below this limit, the speed controlled switch 54 then opens to deenergize the solenoid so that the armature is then retracted to again allow the control valve arrangement 28 to operate as normal in response to both suction and discharge pressure to control the compressor stroke. With such speed responsive control means for effecting destroking, it will thus be appreciated that the compressor is with little addition of parts and modification immediately destroked or caused to remain destroked upon reaching and then remaining above the prescribed speed limit to thereby prolong the compressor's life.

The above described preferred embodiment is illustrative of the invention which may be modified within the scope of the appended claims.

The embodiments of the invention in which an exclusive property or privilege is claimed are defined as follows:

1. In a variable displacement wobble plate type compressor having compression chambers each with a suction valve for admitting fluid thereto at a suction pressure and a discharge valve for delivering the fluid therefrom at a discharge pressure, a sealed crankcase containing a variable angle wobble plate mechanism whose angle and thereby the piston stroke and thus displacement of the compression chambers is made to vary by pressurizing the crankcase using fluid at discharge pressure wherein the displacement is at its minimum when crankcase pressure rises to discharge pressure and is at its maximum when crankcase pressure falls to suction pressure, and a displacement control valve continuously acted upon and normally responsive to at least compressor suction pressure for controlling the pressure in the compressor's crankcase relative to suction pressure so as to normally increase the piston stroke and thereby displacement with increasing suction pressure: the improvement comprising speed responsive control means for directly acting on and positively conditioning said displacement control valve irrespective of the suction pressure so as to increase the crankcase pressure to discharge pressure above but not below a prescribed compressor life limiting speed and thereby decrease the piston stroke and thus displacement to its minimum above but not below said speed.

2. A device according to claim 1 wherein said speed responsive control means comprises a solenoid operated by a speed controlled switch.

* * * * *